US005716751A

United States Patent [19]

Bertrand et al.

[11] Patent Number: 5,716,751

[45] Date of Patent: Feb. 10, 1998

[54] TONER PARTICLE COMMINUTION AND SURFACE TREATMENT PROCESSES

[75] Inventors: Jacques C. Bertrand, Ontario; Steven D. Booth; K. Derek Henderson, both of Rochester; Daniel E. Juda, Penfield; Samir Kumar, Rochester; Dawn M. O'Loughlin, Webster; Lewis S. Smith, Fairport; Zhilei Wang, Penfield, all of N.Y.

[73] Assignee: Xerox Corporation, Stamford, Conn.

[21] Appl. No.: 625,274

[22] Filed: Apr. 1, 1996

[51] Int. Cl.[6] ..... G03G 9/00; B02C 19/06

[52] U.S. Cl. ..... 430/137; 241/5; 241/15

[58] Field of Search ..... 430/137; 241/5, 241/15

[56] References Cited

U.S. PATENT DOCUMENTS

| | | | |
|---|---|---|---|
| 2,297,691 | 10/1942 | Carlson | 430/126 |
| 3,141,882 | 7/1964 | Zimmerly | 260/248 |
| 3,196,032 | 7/1965 | Seymour | 117/16 |
| 3,331,905 | 7/1967 | Hint | 264/122 |
| 3,815,833 | 6/1974 | Vliet et al. | 241/15 |
| 4,345,013 | 8/1982 | Diamond et al. | 430/109 |
| 4,582,731 | 4/1986 | Smith | 427/421 |
| 4,797,339 | 1/1989 | Maruyama et al. | 430/109 |
| 4,816,365 | 3/1989 | Ishikawa . | |
| 4,917,309 | 4/1990 | Zander et al. | 241/5 |

FOREIGN PATENT DOCUMENTS 58-88763 5/1983 Japan .

OTHER PUBLICATIONS

Diamond, Arthur S. Handbook of Imaging Materials. New York: Marcel-Dekker, Inc. pp. 166–170, 193–195, 193–197, 1991.

*Primary Examiner*—Christopher D. Rodee
*Attorney, Agent, or Firm*—John L. Haack

[57] ABSTRACT

A process for preparing toner compositions comprising: coinjecting into a continuously operating fluid energy mill, feed toner particles, and a liquid component; and separating the resulting comminuted toner particles.

17 Claims, 1 Drawing Sheet

TONER PARTICLE COMMINUTION AND SURFACE TREATMENT PROCESSES

REFERENCE TO COPENDING AND ISSUED PATENTS

Attention is directed to commonly owned and assigned U.S. Pat. No. 5,133,504, issued Jul. 28, 1992, entitled "Throughput Efficiency Enhancement of Fluidized Bed Jet Mill".

Attention is directed to commonly owned and assigned, copending application U.S. Ser. No. 08/409,125 filed Mar. 23, 1995 now U.S. Pat. No. 5,562,253, issued Oct. 8, 1996; entitled "Throughput Efficiency Enhancement of Fluidized Bed Jet Mill", wherein there is disclosed a fluidized bed jet mill for grinding particulate material comprising: a grinding chamber having a peripheral wall, a base, and a central axis; an impact target with a hollow cavity defined thereby, and with at least three apertures traversing the walls thereof, the target being mounted within the grinding chamber and centered on the central axis of the grinding chamber; and a plurality of sources of high velocity gas, the gas sources being mounted in the grinding chamber in the peripheral wall, arrayed symmetrically about the central axis, and oriented to direct high velocity gas along an axis substantially perpendicularly intersecting the central axis within the impact target, each of the sources of high velocity gas comprising a nozzle having an internal diameter; wherein the impact target has a cross section area in a plane parallel to the central axis, and the cross section area is greater than the cross section area of the internal diameter of the nozzle; and wherein the distance between the impact target and any of the nozzles is greater than the internal diameter of the nozzle; U.S. Ser. No. 08/571,664 filed Dec. 13, 1995, entitled "FLUIDIZED BED JET MILL NOZZLE AND PROCESSES THEREWITH", wherein there is disclosed a fluidized bed jet mill for grinding particulate material including a jetting nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill; and U.S. Ser. No. 08/623,241 filed Mar. 25, 1996, entitled "LAVAL NOZZLE WITH CENTRAL FEED TUBE AND PARTICLE COMMINUTION PROCESSES THEREOF", which discloses a fluidized bed jet mill for grinding particulate material including a jetting nozzle comprising: a conventional jetting nozzle that has been adapted with a central feed tube which provides for internal recirculation of large particles wherein improved grinder efficiency and grinder throughput are achieved.

The disclosure of the above mentioned patent application are incorporated herein by reference in their entirety.

BACKGROUND OF THE INVENTION

Fluid energy mills or jet mills are size reduction machines in which particles to be ground, known as feed particles, are accelerated in a stream of gas such as compressed air or steam, and ground in a grinding chamber by their impact against each other or against a stationary surface in the grinding chamber. Different types of fluid energy mills can be categorized by their particular mode of operation. Mills may be distinguished by the location of feed particles with respect to incoming air. In the commercially available Majac jet pulverizer, produced by Majac Inc., particles are mixed with the incoming gas before introduction into the grinding chamber. In the Majac mill, two streams of mixed particles and gas are directed against each other within the grinding chamber to cause fracture of the particles. An alternative to the Majac mill configuration is to accelerate, within the grinding chamber, particles that are introduced from another source. An example of the latter is disclosed in U.S. Pat. No. 3,565,348 to Dickerson, et al., which shows a mill with an annular grinding chamber into which numerous gas jets inject pressurized air tangentially.

During grinding, particles that have reached the desired size must be extracted while the remaining, coatset particles continue to be ground. Therefore, mills can also be distinguished by the method used to classify the particles. This classification process can be accomplished by the circulation of the gas and particle mixture in the grinding chamber. For example, in "pancake" mills, the gas is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to, the grinding chamber. Classification can also be accomplished by a separate classifier. Typically, this classifier is mechanical and features a rotating, vaned, cylindrical rotor. The air flow from the grinding chamber can only force particles below a certain size through the rotor against the centrifugal forces imposed by the rotation of the rotor. The size of the particles passed varies with the speed of the rotor; the faster the speed of the rotor, the smaller the particles. These particles become the mill product. Oversized particles are returned to the grinding chamber, typically by gravity.

Yet another type of fluid energy mill is the fluidized bed jet mill in which a plurality of gas jets are mounted at the periphery of the grinding chamber and directed to a single point on the axis of the chamber. This apparatus fluidizes and circulates a bed of feed material that is continually introduced either from the top or bottom of the chamber. A grinding region is formed within the fluidized bed around the intersection of the gas jet flows; the particles impinge against each other and are fragmented within this region. A mechanical classifier is mounted at the top of the grinding chamber between the top of the fluidized bed and the entrance to the collector outlet. "Fluid-energy mill" refers to a fluid-energy or jet mill as described and illustrated in Chemical Engineer's Handbook 8-43 to 8-44 (5th ed. 1973, R. H. Perry and C. H. Chilton, editors) and in George C. Lowrison, Crushing and Grinding, 263–266 (CRC Press, 1974), which are incorporated by reference herein in their entirety. In one class of such mills, the fluid streams convey the particles at high-velocity into a chamber where two streams impact upon each other. All fluid-energy mills have as a common feature, that particle size reduction is achieved primarily by particles colliding with other particles, and not by contact between the particles and grinding surfaces of the mill.

Although fluidized jet mills can be used to grind a variety of particles, they are particularly suited to grinding materials, such as toners, used in electrostatographic reproducing processes. These toner materials can be used to form either two component developers, typically combined with a coarser powder of coated magnetic carrier material to provide charging and transport for the toner, or single component developers, in which the toner itself has sufficient magnetic and charging properties that carrier particles are not required. The single component toners are composed of, for example, resin and a pigment such as commercially available MAPICO Black or BL 220 magnetite. Compositions for two component developers are disclosed in, for example, U.S. Pat. Nos. 4,935,326 and 4,937,166 to Creatura et al.

The toners are typically melt compounded into sheets or pellets and processed in a hammer mill to a mean particle size of between about 400 to 800 microns. They are then ground in the fluid energy mill to a mean particle size of between 3 and 30 microns. Such toners have a relatively low density, with a specific gravity of approximately 1.7 for single component and 1.1 for two component toner. They also have a low glass transition temperature, typically less than about 70° C. The toner particles will tend to deform and agglomerate if the temperature of the grinding chamber exceeds the glass transition temperature.

The primary operating cost of jet mills is for the power used to drive the compressors that supply the pressurized gas. The efficiency with which a mill grinds a specified material to a certain size can be expressed in terms of the throughput of the mill in mass of finished material for a fixed amount of power expended and produced by the expanding gas. One mechanism proposed for enhancing grinding efficiency in particle grinding mills is the projection of particles against a plurality of fixed, planar surfaces, and fracturing the particles upon impact with the surfaces. An example of this approach is disclosed in U.S. Pat. No. 4,059,231 to Neu, in which a plurality of impact bars with rectangular cross sections are disposed in parallel rows within a duct, perpendicular to the direction of flow through the duct. The particles entrained in the air stream passing through the duct are fractured as they strike the impact bars. U.S. Pat. No. 4,089,472 to Siegel et al., discloses an impact target formed of a plurality of planar impact plates of graduated sizes connected in spaced relation with central apertures through which a particle stream can flow to reach successive plates. The impact target is interposed between two opposing fluid particle streams, such as in the grinding chamber of a Majac mill.

A fluid bed jet mill with improved grinding efficiencies and operational economics is available from CONDUX Maschinenbau GmbH & Co (Netzsch Condux Inc. Pennsylvania) as "CONDUX Fluidized Bed Opposed Jet Mill CGS" wherein the jet mill is equipped with a centrally mounted return feed device. The feed device consists of an external pipe line which is connected at one end near the classification zone of the fluid bed chamber and the other end is connected to the high pressure air line at, or near, the nozzle jet inlet to the grind chamber. The external pipe line provides increased material fed to the grind chamber through partial external material return through the jet nozzles.

A well established method for modifying the surface properties of fine particulate material with a surface additive is by spray drying, reference for example, U.S. Pat. Nos. 4,816,365, and 4,797,339, the disclosures of which are incorporated by reference herein in their entirety, wherein preformed particles, such as toner resins, are suspended in a liquid containing a solution or a suspension of the surface additive component, and the resulting mixture is thereafter sprayed to coat the surface additive on to the particle surface and to facilitate the removal of the liquid.

The following patents are of interest to the background of the present invention.

U.S. Pat. No. 4,582,731, issued Apr. 15, 1986, to Smith, discloses the formation of solid films, or fine powders, by dissolving a solid material into a supercritical fluid solution at an elevated pressure and then rapidly expanding the solution through a short orifice into a region of relatively low pressure. This produces a molecular spray which is directed against a substrate to deposit a solid thin film thereon, or discharged into a collection chamber to collect a fine powder. Upon expansion and supersonic interaction with background gases in the low pressure region, any clusters of solvent are broken up and the solvent is vaporized and pumped away. Solute concentration in the solution is varied primarily by varying solution pressure to determine, together with flow rate, the rate of deposition and to control in part whether a film or powder is produced and the granularity of each. Solvent clustering and solute nucleation are controlled by manipulating the rate of expansion of the solution and the pressure of the lower pressure region. Solution and low pressure region temperatures are also controlled.

U.S. Pat. No. 3,331,905, issued Jul. 18, 1967, to Hint, discloses a method of particle size reduction by jet milling, including coinjecting water wherein the resulting particles, such as sand and ores, have reduced fines fraction and greater flowability.

U.S. Pat. No. 3,196,032, issued Jul. 20, 1964, to Seymour, discloses a method of manufacturing electrostatic printing ink comprising dry mixing a polyvinyl acetate resin with lampblack; introducing the mixture into a fluid bed reactor; passing pressurized dry air upwardly through the mixture to form a dense phased fluidized mass; passing an acetone vapor in which the resin is soluble through the dense fluidized mass whereby the resin powder is slightly softened and made relatively tacky so that particles of the lamp black powder become partially imbedded in and bonded to the surfaces of the resin material; and air drying the fluidized mass with pressurized air without the solvent to a powder consistency. The method appears to require separate steps to accomplish: resin particle size reduction, particle surface softening and imbedding, and air drying to achieve a powdery consistency.

U.S. Pat. No. 3,141,882, issued Jul. 21, 1964, to Franz et al., discloses a method of producing a solid finely divided free flowing non-caking cyanuric chloride containing 0.3 to 3 percent of a finely divided inorganic substance, such as, silicic acid, and calcium silicate, comprising injecting the finely divided substance with the aid of an inert gas into a gas containing cyanuric chloride vapor distributed therein and condensing the cyanuric substance to recover a solid free flowing non-caking cyanuric chloride containing 0.3 to 3 percent of a finely divided inorganic substance.

U.S. Pat. No. 3,606,270, issued Sep. 20, 1971, to Zimmerty, discloses a continuous powder blending process wherein a particulate material from a hopper is fed through a feed tube into the eye of the impeller of a centrifugal pump and liquid is also directed into the eye by a tube which is concentric with and surrounds the first tube, both materials then traveling through the impeller together, there being a peripheral casing portion surrounding the impeller from which the mixture is discharged tangentially, and there optionally being a central screen surrounding the impeller to insure proper mixing.

U.S. Pat. No. 5,021,554, filed Jun. 4, 1991, to Thompson, discloses a process for protein particle size reduction using a fluid-energy mill wherein the particle size of amorphous protein material is reduced to uniform particulates without protein decomposition or loss of activity by passing the material through a fluid-energy mill.

U.S. Pat. No. 3,802,089 discloses the use of a dewatering unit to remove water from organic waste prior to its injection into a toroidal drying zone. The teaching of this reference is, however, limited to the use of a centrifuge or a vacuum filter or a combination of the two.

While the above mentioned references provide for improvements in fine particle processing efficiency, there is still a need for further improvements in methods for grinding fine particles in fluidized bed jet mills, and in embodiments, simultaneously grinding and surface treating the resulting fine particles.

Although present fluidized bed jet mill grinding and throughput efficiencies are satisfactory, they could be enhanced to provide a significant improvements and economic advantages, especially energy savings provided by increasing the operational efficiency of the mill itself or by enabling the combination of one or more unit operations.

A long standing problem in the preparation of high performance xerographic materials, such as toners and carriers, is the need to expend considerable time and energy in manipulating the materials during surface treatment or surface coating steps, for example, the removal of liquid substances, such as solvent or liquid carrier vehicles used during coating process steps. Examples include solution coating of carrier particles with a suitable soluble resin coating material, and the application of charge control additives to the surface metal oxide particle flow aid particles or toner particles, reference for example, U.S. Pat. No. 4,937,157, the disclosure of which is incorporated herein in its entirety.

These and other problems have been unexpectedly solved in embodiments of the present invention wherein there are provided superior results arising from simultaneously grinding and surface treating particulate materials.

SUMMARY OF THE INVENTION

It is an object of the present invention to overcome deficiencies of prior art grinding processes and to provide grinding processes with improved grinding efficiency, improved grinder throughput, and improved operational economies.

Another object of the present invention, in embodiments, is to provide improved grinding processes which produce ground particulate materials with improved flow properties.

In yet another object of the present invention, in embodiments, there is provided improved grinding processes which produce finely ground particulate materials with improved triboelectric charging properties.

In another object of the present invention there is provided, in embodiments, a process for preparing toner compositions comprising: coinjecting into a continuously operating fluid energy mill, feed particles, such as toner resin particles, and a liquid component; and separating the resulting comminuted particles.

In still another object of the present invention is provided, in embodiments, a method of grinding particles comprising: simultaneously introducing into a grinding chamber of a fluidized bed jet mill, unground feed particles, a liquid component, and an optional additive contained in the liquid component; injecting gas from a plurality of sources of high velocity gas into the grinding chamber through a nozzle or nozzles which provides a conduit for high pressure gas, wherein one end of the body is directed towards the center of the jet mill and the other end traverses the wall of the jet mill; forming a fluidized bed of the unground particles within the chamber; continuously entraining and accelerating a portion of the unground particles with the high velocity gas to form a high velocity particle gas stream; fracturing the portion of the entrained particles into smaller particles by projecting the particle gas stream against opposing particle gas streams; separating from the unground particles and the smaller particles a portion of the smaller particles smaller than a selected size; discharging the portion of the smaller particles from the grinding chamber; and continuing to grind the remainder of the smaller particles and the unground particles by reentrainment until the smaller particles, smaller than a selected size, are obtained thereby, wherein the relative throughput grinding efficiency is improved from about 1 percent to about 30 percent compared to a mill which does not employ the coinjection of a liquid component with the feed particles, and wherein the resulting comminuted particles are substantially free flowing and are substantially free of the liquid component.

Another object of the present invention provides, in embodiments, a method for grinding particles of electrostatographic toner and developer materials comprising: continuously coinjecting into a continuously operating fluid bed jet mill, a mixture of feed particles, a liquid component in which the feed particles are substantially insoluble, and a performance additive which can be soluble or insoluble in the liquid component and can be either soluble or insoluble in the feed particles; effecting simultaneous grinding and surface treatment of the spectrum of particle sizes resident in the grind chamber, and separating small sized comminuted particles from larger particles, wherein the surfaces of the separated particles are partially or completely coated to a useful extent with the additive material.

In another object of the present invention there is provided, in embodiments, particle surface modification processes wherein the additive material possesses useful mechanical properties, such as abrasive properties which enable the alteration of the feed particle's initially ground state surface properties, for example, toughening or smoothing of the feed particle surface. In this embodiment, the additive particle is preferably subsequently easily separated from the particle surface.

In still another object of the present invention is provided, in embodiments, a method for grinding particles of electrostatographic developer materials, for example, single and two component developers and toners.

In another object of the present invention, in embodiments, is the provision of high efficiency processes and apparatus for grinding particulate materials and which processes and apparatus substantially simplify the grinder system complexity and the costs associated with construction, modification, and operation thereof.

It is an object of the present invention to provide, in embodiments, simple and economical processes and apparatus for simultaneously grinding and surface treating or surface modifying particulate materials.

Yet another object of the present invention, in embodiments, is to provide an increase in the lubricity and flowability of large, intermediate, and small particulate materials within and through the grind chamber of a fluid bed jet mill during continuous grinding processes thereby facilitating the grindability and the efficiency of fluid bed jet mill grinding processes.

In still yet another object of the present invention, in embodiments, is to provide increased accessibility of particulate materials to the high speed gas stream grinding surface available to feed particles, or alternatively, increasing the accessibility of feed and intermediate sized particles to the gas stream effective grinding surface, for the purpose of achieving enhanced particle acceleration, collision and breakage.

Although not wanting to be limited by theory, it is believed that aforementioned increased accessibility of the feed and intermediate particles to the effective grinding surface of the gas jet stream is achieved, in embodiments of the present invention, by the inclusion of the liquid component in the grind mixture which may act, for example, as an interparticle lubricant, a resin deplastizer, or rigidification agent, wherein for example, an interparticle lubricant mechanism may facilitate the entrance of larger particles to, and the exit of smaller particles from the effective grinding surface of the gas jet stream, and may account for the observed improvements in particle grinding efficiency, particle flowability properties, and surface coating properties of the resulting particles.

Furthermore, although not wanting to be limited by theory, it is believed that the coinjection conditions employed in the present process invention, for example, 300 degrees Kelvin, and the pressure inside the grinding chamber is about 2 psig, are substantially subcritical and the coninjected liquid component is substantially present as a liquid phase at coinjection.

Other objects, features, and advantages of the present invention will be apparent to those of ordinary skill in the art from the following detailed description of the invention.

DETAILED DESCRIPTION OF THE INVENTION

Figure 1:
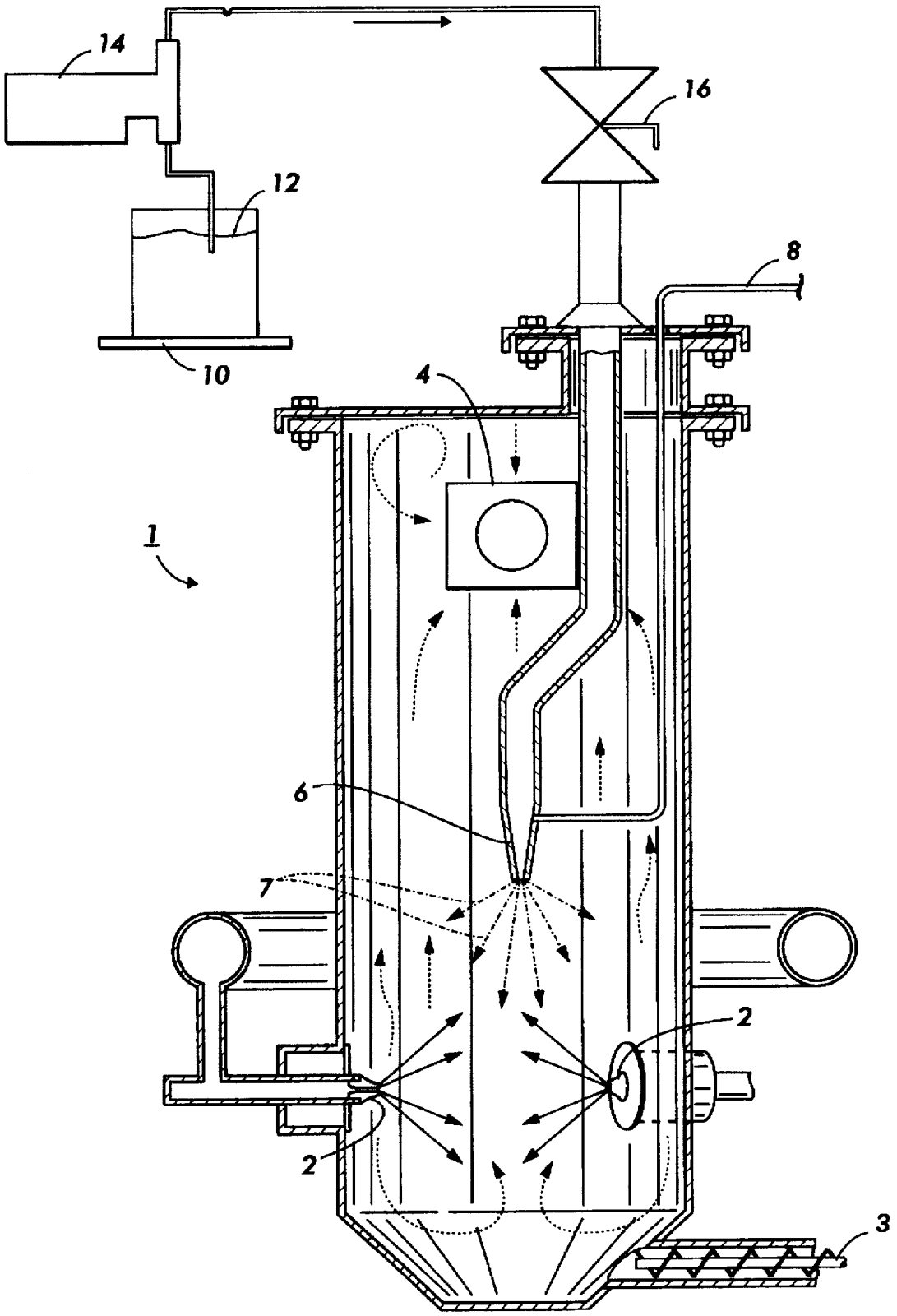
FIG. 1 is a schematic representation in section of a commercially available fluid bed jet mill which has been modified in accordance with the present invention, in embodiments, which modified mill provides for simultaneous and continuous coinjection of a liquid component as a separate stream, separate from high pressure air and feed particles, into the grind chamber of the jet mill.

The present invention provides, in embodiments, improvements in the particle jetting efficiency of prior art fluid bed jet mills by employing an improved method for grinding particles, specifically, compatible liquid materials, that is, non resin dissolving liquids, are continuously coinjected in minor amounts along with feed toner particles into a fluid energy jet mill with the result that a number of processing and material property advantages are afforded as illustrated herein.

The present invention, in embodiments, provides energy efficient and operationally efficient semi-wet and vapor phase continuous methods of surface treating toner and related particulate materials with various performance enhancing surface additive materials as illustrated herein.

In embodiments, the present invention provides a process for preparing toner compositions comprising: coinjecting into a continuously operating fluid energy mill, feed toner particles, and a liquid component; and separating the resulting comminuted toner particles. The comminuted toner particles are free flowing and substantially free of residual liquid. Thus, the processes of the present invention are well suited for rapid and efficient treatment of a variety of particulate materials.

The present invention enables simultaneous or combination of particle processing unit operations, such as particle size reduction, liquid/vapor surface coating, and drying of the resulting comminuted particulate materials. Processes of the present invention therefore, in embodiments, obviate the need for sequential processing steps, such as grinding, fluidized bed surface coating, and spray or freeze drying.

The liquid component, in embodiments, can be coinjected in an amount of from about 0.001 to about 20 weight percent based on the weight of the coinjected feed particles. In preferred embodiments, for example, for surface treating toner particles with a surface additive, such as a flow aid, or a surface applied charge additive, the liquid component can be continuously coinjected in an amount of from about 1 to about 10 weight percent based on the weight of the coinjected feed particles.

Any liquid component can be selected which is sufficiently volatile so as to be readily volatilized or vaporized by the dry air entering the fluid bed jet mill. In a preferred embodiment, the feed toner particles are substantially insoluble in the liquid component. Examples of suitable liquids include, but are not limited to, water, resin insoluble organic liquids, and mixtures thereof, for example, alcohols, ethers, pyrolidones, and the like liquids. The liquid component can also comprise an aqueous or non-aqueous mixture, including a solid-liquid suspension or liquid-liquid suspension, emulsions, and solutions.

The resulting comminuted toner particles are, in preferred embodiments, free flowing and substantially free of the liquid component selected to accomplish the coinjection of feed particles, a liquid component, and optionally an additive contained in the liquid component. For example, when water is selected as the liquid component, the measured water content in the resulting product is essentially the same as the measured water content obtained when particle grinding is accomplished in the conventional dry manner. The water content of feed particles, and resulting comminuted particles is readily determined and compared using known chemical or physical analytical methods, such as Karl-Fischer method.

In embodiments of the present invention, for toners that were prepared containing magnetite, the measured surface amount of magnetite was apparently different when water only was coinjected. For example, scanning electron microscopy (SEM) indicated that there were fewer magnetite particles residing on the toner surface, therefore a smoother toner surface resulted.

In embodiments of the present invention, for toners that were prepared with a water soluble dye coinjected with a polymer, the resulting toner surface was partially covered with areas of dye as was evident from optical microscopy. Chemical analysis can also be used to quantify the amount of additive which ends up on the toner surface.

In embodiments, if a water soluble polymer is coinjected with water and toner particles, it is expected that the resulting ground toner particles will be covered either partially or completely depending on the amount of water soluble material coinjected. The resulting toner particle surface can be modified, for example made smoother, or harder, than the pregrind starting material surface depending on the additive selected and the amount coinjected, and the resulting ground toner material can have correspondingly higher or lower blocking temperatures.

In embodiments, if a non soluble component is coinjected, such as a hard high molecular weight polymer in the form of particulates which are smaller than the toner particles, it is expected that the coinjected particles, that is, the surface particles, are firmly and uniformly attached to the surface of the toner particles.

With respect to optional additives for use in the liquid component, there may be selected additives which are soluble, weakly or partially soluble, and insoluble. The additives are preferably formulated, by for example, dissolution or suspension, into the liquid component prior to coinjection. Suitable insoluble additives include, but are not limited to metal oxides, surface treated metal oxides, charge control additives, pigments, dyes, latex emulsion polymer particles, lubricants, waxes, conductivity control agents, humidity sensitivity control agents, and the like additives, and mixtures thereof. Suitable soluble additives include but are not limited charge control additives, polymers, dyes, fragrances, lubricants, waxes, conductivity control agents, humidity sensitivity control agents, and mixtures thereof. Whether an additive is soluble, partially soluble or insoluble is frequently highly dependent upon the combination of additive amount and additive type, and the solvolyzing power, of the liquid component. Thus, as will be readily evident to one of ordinary skill in the art, solutions or suspensions of an additive and a liquid component can readily be formulated empirically or from a consideration of known solubility principles of the additive and know solvent power of the liquid.

The coinjected feed particles, such as toner particles, can have a number average diameter of greater than about 50 microns and the resulting comminuted toner particles have a number average diameter of less than about 15 microns. In preferred embodiments, the resulting toner particles can have a number average diameter of less than about 7 microns, and preferably from about 3 to about 6 microns, for example, as used in high fidelity color xerographic applications.

In an exemplary toner processed in accordance with the present invention, the outer or particle surface layer comprising for example, a charge additive or flowability imparting agent completely covers the particle surface as thin layer with a average thickness of, for example, less than 0.5 microns. However, it should be readily evident to one of ordinary skill in the art that it is not necessary for the outer layer to cover the entire surface of the toner resin particle to achieve desired or optimal properties. It is only necessary that the surface layer cover the surface to the an extent as is necessary for the toner to have good particle properties, such as flowability and or chargability.

In exemplary process embodiments, the fluid energy mill can have a throughput rate of toner particles of from about 1 to about 1,000 pounds per hour. In preferred embodiments, the fluid energy mill can have a throughput rate of toner of from about 5 to about 500 pounds per hour.

In other exemplary process embodiments, when toner particles are selected for simultaneous particle size reduction and surface treatment, the feed toner particles can be comprised of resin, and a colorant. In other embodiments, the feed toner particles further comprise internal and external additives selected from the group consisting of magnetic pigments, charge control additives, flow additives, charge control agent retention additives, resin compatibilizers, lubricants, and the like particles, and mixtures thereof.

Toner particles suitable for simultaneous particle size reduction and surface treatment as provided for in the present invention can be comprised of any known jettable and friable resin such as, styrene-diene copolymers, styrene-acrylate copolymers, polyesters, polyamides, and the like polymeric resin, and mixtures thereof.

Toner formulation prepared in accordance with the present invention, in embodiments, exhibited improved cohesion and fines content properties after grinding of toner materials and subsequent to classification processes wherein water was coinjected into the grind chamber compared to control toner samples which used only dry air.

For accomplishing the processes of the present invention, a suitable fluidized bed jet mill for grinding particulate material is selected; an exemplary fluid bed mill comprises: a grinding chamber having a peripheral wall, a base, a central axis, and a plurality of sources of high velocity gas, the gas sources being mounted within the grinding chamber or on the peripheral wall, arrayed symmetrically about the central axis, and oriented to direct high velocity gas along an axis substantially perpendicularly intersecting the central axis, the central axis being situated at the intersection of gas streams, for example, as disclosed in the aforementioned commonly owned U.S. Pat. No. 5,133,504, or in copending U.S. Ser. No. 08/409,125 now U.S. Pat. No. 5,562,253, issued Oct. 8, 1996, the respective disclosures are incorporated by reference in their entirety herein.

Referring to the FIGURE, a commercially available jet mill grind chamber 1 equipped with a plurality of air jet nozzles 2, a means for introducing feed particles to be ground, such as an auger 3 connecting a hopper(not shown) of feed particles to the grind chamber, and a classifier 4, is modified with a liquid component delivery system comprising an ultrasonic spray nozzle, for example, a SONIMIST ultrasonic spray nozzle, Model HSS-600-2 available from Misonix Inc., Farmingdale, N.Y., which produces a fine liquid spray or mist 7 of the liquid component when introduced to the grind chamber. The liquid spray or mist is created by, for example, attaching a compressed air line 8 to the tip or orifice of nozzle 6. The liquid component can be delivered to the nozzle 6 by any suitable means, for example as illustrated, a load cell 10 containing a liquid component 12, neat or as a solution or suspension of a surface additive, can be controllably advanced to the nozzle and regulated with a pneumatic or mechanical liquid pump 14 and valve 16 means. The nozzle can have one or more spray orifices and a variety of orifice diameters can be selected so that the objects of the present invention are achieved.

In embodiments, the aforementioned liquid component delivery system and spray nozzle 6 can be configured within or immediately adjacent to high pressure air jet nozzle(s) 2 to facilitate the entrainment and dispersion of the liquid component into the air jet or air-particle jet stream. The spray mist nozzle can be positioned in various locations and oriented so as to achieved the desired results. Positioning of the nozzle in the mill preferably avoids "dead zone", that is, those areas which have little or no particle circulation, and which zones can be determined empirically. Although not wanting to be limited by theory, it is believed that a high pressure gas stream or air jet, for example, passing through a nozzle 2 opening, continuously expands as the jet enters the grind chamber. Similarly, the introduction of the pressurized liquid component into the grind chamber through pressurized spray nozzle 6 is believed to be provide transient fine droplets or misting which facilitates liquid component dispersion, and ultimately results in entrainment of liquid component and any additive in the gas-particle jet stream or the surface thereof. Thus, the liquid component, and optional additives, can be introduced simultaneously into the particle grinding process in the fluid bed jet mill, for example, remote from the jet nozzle as illustrated in the Figure where a complete spectrum of large to small particle sizes are present, within the jet nozzle wherein substantially only continuously moving high pressure air is present, or adjacent to the air jet nozzle 2.

In embodiments, a liquid component is continuously coinjected into a continuously operating fluid bed jet mill in accordance with the present invention wherein the relative throughput efficiency and grinding efficiency of the mill is improved by from about 1 to about 30 percent depending upon the material selected for grinding and the nominal particle size desired.

In still other embodiments of the present invention there is provided, a method of grinding particles comprising: simultaneously introducing by coinjection means unground feed particles and a liquid component into a grinding chamber of a fluidized bed jet mill; injecting gas from a plurality of sources of high velocity gas into the grinding chamber through a nozzle or nozzles; wherein the nozzle communicates the gas stream from the high pressure source to the grinding chamber; forming a fluidized bed of the unground particles within the chamber; continuously entraining and accelerating a portion of the unground particles with the high velocity gas to form a high velocity particle gas stream; fracturing the portion of the entrained particles into smaller particles by projecting the particle gas stream against opposing particle gas streams; separating from the unground particles and the smaller particles a portion of the smaller particles smaller than a selected size; discharging the portion of the smaller particles from the grinding chamber; and continuing to grind the remainder of the smaller particles and the unground particles by, for example, reentrainment until the smaller particles, smaller than a selected size, are obtained thereby, and where an improvement in the grinder throughput is realized of from about 1 to about 30 percent.

In embodiments, the present invention provides a method for grinding particles of electrostatographic developer material substantially as recited above and as illustrated herein.

In embodiments, the jet nozzle can optionally employ an integral face plate member attached to the end of the nozzle tip for the purpose of manipulating and directing the gas-jet and resulting particle-jet streams.

In embodiments, the unground particles are electrostatographic developer material particles with a mean volume diameter of about 20 to about 10,000 microns and the smaller ground particles have a mean volume diameter of about 3 to about 30 microns.

In embodiments, the particulate material for grinding can be toner particles, pigment particles, resin particles, toner surface additive particles, toner charge control additives, uncoated carrier particles, resin coated carrier particles, metal oxide particles, surface treated metal oxide particles, mineral, and mixtures thereof.

In exemplary embodiments, to produce ground toner particles of a styrene/butadiene Xerox Model 5090 toner formulation with a desired size of number average diameter of about 9.0 microns, a 200 AFG fluid energy mill with three 4 mm nozzles set at 120 degrees apart at the periphery of the grinding chamber and coaxially focused at the center with grinding air pressure set at 100 psig is used. The mill is also equipped with a standard classifier wheel set at 7,200 rpm. Simultaneous with particle grinding, a SONIMIST liquid injection nozzle with a 0.012 inch orifice was fed by a Pulsa Feeder, Inc. (Rochester N.Y.) diaphragm metering pump is set at 30 gm/min of liquid, such as water. The sonifying nozzle air pressure is set at 40 psig. The grinding rate of the mill is set for 120 gm/min of toner particles.

The particulate material suitable for grinding and particle size reduction in the present invention can be toner, developer, resin, resin blends and alloys, filled thermoplastic resin composite particles, and the like particles. In preferred embodiments, the particulate material is toner particles, pigment particles, resin particles, toner charge control additives, uncoated carrier particles, resin coated carrier particles, and mixtures thereof. Unground of feed particles are preferably electrostatographic developer material particles with a mean diameter of about 20 to about 10,000 microns. The smaller or ground particles removed from the grinding chamber and process have a mean diameter of about 3 to about 30 microns. The parameters required to achieve desired particle size properties can be determined empirically and is a preferred practice in view of the large number of process variables.

Ground particles are suitable for use as electrostatographic developer material selected from the group consisting of single component and two component toner particles comprising a binder resin, a pigment, and optional additives. A suitable binder resin for particle size reduction in the present invention can have, for example, a broadly distributed molecular weight centered about approximately 60,000.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLES I–VI

Three trials were conducted on an Alpine 200 AFG (available from Alpine AG Augsburg, Germany) fluid bed grinder. The objective of these trials was to evaluate the effectiveness of liquid coinjection processes of a liquid component containing optional additives of the present invention. In working Example trials, a number average particle size of about 9.0 microns was targeted and substantially achieved. Particle throughput rates, liquid injection rates, and particle size data were continuously measured and recorded. The products of grinding were classified on a standard Acucut B18 classifier (available from Micron Powder Systems Inc., Summit N.J.), to remove fines. The percent fines produced, flow and cohesion properties of the product particles relative to comparative examples before and after classification are tabulated in tables of the respective Examples.

EXAMPLE I

COINJECTION OF TONER FEED PARTICLES AND WATER

Into a Alpine 200 AFG fluid bed jet mill, modified in accordance with the Figure and set up with nozzle size of 4 mm operating at 100 psi. The misting nozzle was operated at 60 psi sonifying air and 4 psi liquid pressure. There was continuously coinjected a mixture of a Xerox Model 5090 feed toner particles and water into a fluid energy mill; wherein the feed particles and the water are in a weight ratio of about 120 gm/min toner and 15 gm/min water; and wherein the resulting comminuted toner particles have an average particle size of from about 5 to about 10 microns.

EXAMPLE II

COINJECTION OF TONER FEED PARTICLES AND WATER

Example I was repeated with the exception that 30 gm/min. of water was injected into the mill.

COMPARATIVE EXAMPLE I

Xerox Model 5090 Toner feed particles were ground using the standard Alpine AFG 200 fluid bed jet mill, and set up with nozzle size of 4 mm operating at 100 psi, wherein the feed particles were fed in the mill at a rate of about 120 gm/min toner and wherein the resulting comminuted toner particles have an average particle size of form about 5 to about 10 microns.

A Xerox Model 5090™ toner formulation shows improved cohesion and fines content properties after classification processes wherein water was coinjected as in Example I and Example II compared to the control of Comparative Example I which used only dry air and no liquid coinjection. The results of Example I and II are tabulated in Table I and results of Comparative Example I are in Table 2.

TABLE 1

Water Coinjection with Styrene Butadiene Xerox Model 5090 ™ Toner

| Example | Water Injection Rate (gm/min) | % Cohesion Mean | % Cohesion Std. dev. | % Fines | Moisture Content (wt. %) |
|---|---|---|---|---|---|
| I (after grind) | 15 | 87 | 1 | 58 ± 1 | 0.07 |
| 1 (after class) | | 80 | 3 | 10 | 0.07 |
| II (after grind) | 30 | 72 | 1 | 54 ± | 0.06 |
| II (after class) | | 61 | 1 | 4 | 0.06 |

TABLE 2

Standard Grinding of Xerox Styrene Butadiene Xerox Model 5090 ™ Toner

| Example | Water Injection Rate (gm/min) | % Cohesion Mean | % Cohesion Std. dev. | % Fines | Moisture Content (wt. %) |
|---|---|---|---|---|---|
| Control (after grind) | 0 | 87 | 1 | 56 ± 2 | 0.06 |
| Control (after class) | | 81 | 3 | 10 | 0.05 |

EXAMPLE III

COINJECTION OF TONER FEED PARTICLES AND WATER

Into a Alpine 200 AFG fluid bed jet mill, modified in accordance with the Figure and set up with nozzle size of 4 mm operating at 100 psi. The misting nozzle was operated at 60 psig sonifying air and 4 psi liquid pressure. There was continuously coinjected a mixture of polyester feed toner particles and water into a fluid energy mill; wherein the feed particles and the water are in a weight ratio of about 120 gm/min toner and 30 gm/min water; and wherein the resulting comminuted toner particles have a number average diameter particle size of from about 5 to about 10 microns.

COMPARATIVE EXAMPLE II

COMPARISON TO EXAMPLE III

Selfsame polyester toner feed particles were ground using the standard Alpine AFG 200 fluid bed jet mill, and set up with nozzle size of 4 mm operating at 100 psi wherein the feed particles were fed in the mill at a rate of about 120 gm/min toner and wherein the resulting comminuted toner particles have an average particle size of form about 5 to about 10 microns.

The polyester toner formulation obtained from Example III shows superior and improved cohesion and reduced fines content properties after classification processes wherein water was coinjected as compared to a control of Comparative Example II which used only dry air. The results are tabulated in Table 3 and 4, respectively.

TABLE 3

Water Coinjection with Polyester Toner

| Example | Injection material (rate) | % Cohesion Mean | % Cohesion Std. dev. | % Fines | Moisture Content (wt. %) |
|---|---|---|---|---|---|
| III (after grind) | Water (30 gm/min) | 90 | 0 | 60 ± 2 | 0.31 |
| III (after double pass class) | | 88 | 1 | 8 | 0.34 |

TABLE 4

Standard Grinding of Polyester Toner

| Example | Injection material (rate) | % Cohesion Mean | % Cohesion Std. dev. | % Fines | Moisture Content (wt. %) |
|---|---|---|---|---|---|
| Comp II (grind) | Control (no water) | 99 | 2 | 55 ± 3 | 0.36 |
| Comp II (double pass class) | | 97 | 1 | 20 | 0.36 |

EXAMPLE IV

COINJECTION OF TONER FEED PARTICLES AND WATER

Into a Alpine 200 AFG fluid bed jet mill, modified in accordance with the Figure and set up with nozzle size of 4 mm operating at 100 psi. The misting nozzle was operated at 60 psi sonifying air and 4 psi liquid pressure. There was continuously coinjected a mixture of a experimental single component magnetic styrene acrylate feed toner particles and water into a fluid energy mill; wherein the feed particles and the water are in a weight ratio of about 120 gm/min toner and 25 gm/min water, and wherein the resulting comminuted toner particles have an average particle size of from about 5 to about 10 microns.

COMPARATIVE EXAMPLE III

COMPARISON TO EXAMPLE IV

Experimental single component magnetic styrene acrylate toner feed particles were ground using the standard Alpine AFG 200 fluid bed jet mill, and set up with nozzle size of 4 mm operating at 100 PSI wherein the feed particles were fed in the mill at a rate of about 120 gm./min toner and wherein the resulting comminuted toner particles have an average particle size of from about 5 to about 11 microns.

A single component magnetic styrene acrylate toner formulation shows improved cohesion and reduced fines content properties after classification processes wherein water was coinjected as in Example IV compared to control Comparative Example III which used only dry air. The results are tabulated in Table 5 and 6, respectively.

TABLE 5

| Water Coinjection with Single Component Magnetic Styrene Acrylate Toner | | | | | |
|---|---|---|---|---|---|
| Material | Injection material (rate) | % Cohesion Mean | % Cohesion Std. dev. | % Fines 1.26–4.0 microns | % Fines 1.26–5.0 microns |
| IV (after grind) | Water (25 gm/min) | 57 | 0.5 | 58 ± 2 | 67 ± 2 |
| IV (after double pass class) | | 38 | 0 | 2 | 4 |

TABLE 6

| Standard Grinding Single Component Magnetic Styrene Acrylate Toner | | | | | |
|---|---|---|---|---|---|
| Material | Injection material (rate) | % Cohesion Mean | % Cohesion Std. dev. | % Fines 1.26–4.0 microns | % Fines 1.26–5.0 microns |
| Comp III (after grind) | 0 | 70 | 1.4 | 60 ± 0 | 69 ± 0 |
| Comp III (after double pass class) | | 54 | 0.1 | 5 | 8 |

EXAMPLE V

COINJECTION OF TONER FEED PARTICLES AND A MIXTURE OF WATER AND A WATER INSOLUBLE COMPONENT

Example I was repeated with the exception that was and there was continuously coinjected a mixture of feed toner particles a mixture of water and a dispersed water insoluble component, such as Fanal Pink (BASF Corp. Germany) pigment which has a primary particle size of 0.1 microns. The liquid was coinjected into the fluid energy mill; wherein the feed particles and the water are in amounts of 120 gm/min feed toner particles and /30 gm/min of water/suspension and the water insoluble additive is present in an amount of about 2 weight percent with respect to the water content. The resulting comminuted toner particles have an average particle size of form about 5 to about 10 microns. The resulting toner has Fanal Pink particles evenly distributed on the surface of the toner particles and the pigment surface particles have an average particle size of about 0.1 microns as observed by SEM.

EXAMPLE VI

COINJECTION OF TONER FEED PARTICLES AND A MIXTURE OF WATER AND A WATER SOLUBLE COMPONENT

Example I was repeated with the exception that there was continuously coinjected a mixture of feed toner particles a mixture of water and a water soluble component, such as Basic Blue 9 dye (Hoechst Corp. Germany), into a fluid energy mill; wherein the feed particles and the water are in a weight ratio of 120 gm/min feed toner particles and 30 gm/min of water and the water soluble additive is present in an 0.5 weight percent with respect to the water content. The resulting comminuted toner particles have an average particle size of from about 5 to about 10 microns. The resulting toner has Basic Blue 9 dye evenly distributed on the surface as observed by optical microscopy.

EXAMPLE VII

COINJECTION OF TONER FEED PARTICLES AND A MIXTURE OF AQUEOUS ALCOHOL AND A SOLUBLE CHARGE CONTROL AGENT

In to a Alpine AFG 200 fluid bed jet mill operating at conditions as in the previous example was continuously coinjected feed toner particles and a mixture of water and methanol in a weight ratio of about 1:1 into a fluid energy mill. The feed particles and the water-alcohol mixture are in a weight ratio of 120 gm/min feed toner particles to 30 gm/min of water/alcohol and the water/alcohol soluble additive ZONYL a fluoro surfactant available from E. I. DuPont Co., is present in a 0.5 weight percent with respect to the water/alcohol content. The resulting comminuted toner particles have an average particle size of form about 5 to about 10 microns. The resulting toner has ZONYL evenly distributed on the surface as analyzed by chemical and spectroscopic methods.

EXAMPLE VIII

COINJECTION OF TONER FEED PARTICLES AND A MIXTURE OF WATER AND A WATER SOLUBLE FRAGRANCE COMPONENT

Example I was repeated with the exception that there was continuously coinjected a mixture of feed toner particles a mixture of water and a water soluble fragrance Chanel No. 5 (Chanel Fragrance Co.), into a fluid energy mill; wherein the feed particles and the water are in a weight ratio of 120 gm/min feed toner particles to 30 gm/min of water, and the water soluble additive is present in a 0.5 weight percent with respect to the water content. The resulting comminuted toner particles have an average particle size of from about 5 to about 10 microns. The resulting toner is believed to have the fragrance additive evenly distributed on the surface consistent with a persistent fragrant odor emanating from the ground particles.

EXAMPLE IX

COINJECTION OF TONER FEED PARTICLES AND A MIXTURE OF WATER AND A WATER SOLUBLE POLYMER COMPONENT

Example I was repeated with the exception that there was continuously coinjected a mixture of feed toner particles a mixture of water and a water soluble acrylate polymer, Syntran 1560 (Interpolymer Corp., Canton, Mass.), into a fluid energy mill; wherein the feed particles and the water are in a weight ratio of 120 gm/min feed toner particles to 30 gm/min of water, and the water soluble additive is present in an 4.0 weight percent with respect to the water content. The resulting comminuted toner particles have an average particle size of from about 5 to about 10 microns. The resulting toner has the polymer additive evenly distributed on the surface as evidenced by analysis by HPLC.

EXAMPLE X

COINJECTION OF TONER FEED PARTICLES AND WATER

Into a Alpine 200 AFG fluid bed jet mill, modified in accordance with the Figure and set up with nozzle size of 4 mm operating at 100 psi, there was continuously coinjected a mixture of a experimental polyester feed toner particles and water into a fluid energy mill. The feed particles and the water are in a weight ratio of about 120 gm/min toner and 30 gm/min water. The misting nozzle was operated at 60 PSI sonifying air and 4 psi liquid pressure. The resulting comminuted toner particles have an average particle size of from about 8.5 to about 8.6 microns. The polyester toner formulation shows improved throughput rate of the jet mill and reduced fines content properties after classification processes wherein water was coinjected as compared to a control which used only dry air. The results are tabulated in Table 7 and compared to a control example which did not employ coinjection.

TABLE 7

Water Coinjection with Polyester Toner

| Example | Injection material (rate) | throughput rate (lbs/hr.) | Volume Median | % Fines after class 1 | % Fines after class 2 |
|---|---|---|---|---|---|
| control | 0 | 12 | 8.5 | 37 | 19 |
| X | Water (30 gm/min) | 14 | 8.6 | 27 | 8 |

The aforementioned patents and publications are incorporated by reference herein in their entirety.

Other modifications of the present invention may occur to those skilled in the art based upon a review of the present application and these modifications, including equivalents thereof, are intended to be included within the scope of the present invention.

What is claimed is:

1. A process for preparing toner compositions comprising:

coinjecting into a continuously operating fluid energy mill feed toner particles comprising a mixture of a resin and a colorant, and a liquid component selected from the group consisting of water, resin insoluble organic liquids, and mixtures thereof; and separating the resulting comminuted toner particles, wherein the liquid component prior to coinjection contains a soluble additive, insoluble additive, or mixtures thereof, wherein the soluble additive is selected from the group consisting of charge control additives, polymers, dyes, pigments, fragrances, lubricants, waxes, conductivity control agents, humidity sensitive control agents, and mixtures thereof, and wherein the insoluble additive is selected from the group consisting of metal oxides, surface treated metal oxides, charge control additives, pigments, dyes, latex polymer particles, lubricants, waxes, conductivity control agents, humidity sensitive control agents, and mixtures thereof.

2. A process in accordance with claim 1 wherein the comminuted toner particles are free flowing and substantially free of residual liquid.

3. A process in accordance with claim 1 wherein the liquid component is coinjected in an amount of from about 0.001 to about 20 weight percent based on the weight of the coinjected feed particles.

4. A process in accordance with claim 1 wherein the liquid component is coinjected in an amount of from about 1 to about 10 weight percent based on the weight of the coinjected feed particles.

5. A process in accordance with claim 1 wherein the comminuted toner particles are free flowing and substantially free of water.

6. A process in accordance with claim 1 wherein the feed toner particles are substantially insoluble in the liquid.

7. A process in accordance with claim 1 wherein the liquid comprises an aqueous or non-aqueous mixture selected from the group consisting of suspensions, emulsions, and solutions.

8. A process in accordance with claim 1 wherein the coinjected feed toner particles have a number average diameter of greater than about 50 microns and wherein the resulting comminuted toner particles have a number average diameter of less than about 15 microns.

9. A process in accordance with claim 1 wherein the resulting toner particles have a number average diameter of less than about 7 microns.

10. A process in accordance with claim 1 wherein the fluid energy mill has a throughput rate of toner of from about 1 to about 1,000 pounds per hour.

11. A process in accordance with claim 1 wherein the fluid energy mill has a throughput rate of toner of from about 5 to about 500 pounds per hour.

12. A process according to claim 1, wherein the feed toner particles further comprise internal and external additives selected from the group consisting of magnetic pigments, charge control additives, flow additives, charge control agent retention additives, resin compatibilizers, lubricants, and mixtures thereof.

13. A process according to claim 1, wherein the feed toner particles comprise a resin selected from the group consisting of aryl-diene copolymers, styrene-acrylate copolymers, polyesters, polyamides, and mixtures thereof.

14. A process in accordance with claim 1 wherein the additive is insoluble in the liquid.

15. A process in accordance with claim 1 wherein the additive is soluble and in the liquid.

16. A process in accordance with claim 1 wherein the resulting comminuted toner particles have reduced particle fines content and improved bulk particle flow properties as measured by reduced particle cohesiveness compared to comminuted toner particles processed in the absence of said coinjected liquid component.

17. A process for preparing a toner composition comprising:

continuously coinjecting a mixture of feed toner particles comprising a mixture of a resin and a colorant, and water into a fluid energy mill, wherein the feed particles and the water are in a weight ratio of about 80:20 to about 99:1, and wherein the resulting comminuted toner particles have an number average diameter particle size of from about 5 to about 10 microns and wherein the water prior to coinjection into the fluid energy mill contains an additive selected from the group consisting of a fluorinated surfactant, metal oxides, surface treated metal oxides, charge control additives, pigments, dyes, latex polymer particles, lubricants, waxes, conductivity control agents, humidity sensitivity control agents, and mixtures thereof.

* * * * *